US006509839B2

(12) United States Patent
Nagatuska

(10) Patent No.: US 6,509,839 B2
(45) Date of Patent: Jan. 21, 2003

(54) CONTROL LEVER FOR EARTH MOVING MACHINES

(75) Inventor: Isao Nagatuska, Hanyu (JP)

(73) Assignee: Komatsu Utility Europe S.p.A., Vicentina (IT)

( * ) Notice: Subject to any disclaimer, the term of this patent is extended or adjusted under 35 U.S.C. 154(b) by 0 days.

(21) Appl. No.: 09/886,038

(22) Filed: Jun. 22, 2001

(65) Prior Publication Data

US 2002/0140568 A1 Oct. 3, 2002

(30) Foreign Application Priority Data

Mar. 29, 2001 (EP) ..... 01830217

(51) Int. Cl.[7] ..... G08B 3/00

(52) U.S. Cl. ..... 340/691.1; 340/815.48; 340/815.47; 200/335; 200/341

(58) Field of Search ..... 340/691.1, 825.17, 340/679, 815.47, 815.48, 501; 701/50, 815.48; 200/61.85, 61.88, 61.91, 335, 341

(56) References Cited

U.S. PATENT DOCUMENTS 4,561,188 A * 12/1985 Williams et al. ..... 33/366
4,884,057 A * 11/1989 Leorat ..... 340/456
4,994,635 A * 2/1991 Cummings et al. ..... 200/61.86
5,042,314 A * 8/1991 Rytter et al. ..... 74/335
5,566,586 A * 10/1996 Lauer et al. ..... 74/523
5,845,735 A * 12/1998 Muller et al. ..... 180/322
6,128,563 A * 10/2000 Muraro ..... 701/50
6,148,593 A * 11/2000 Heinsey et al. ..... 56/10.2
6,152,676 A * 11/2000 Evert et al. ..... 414/631
6,173,622 B1 * 1/2001 Carnevale et al. ..... 180/336

* cited by examiner

*Primary Examiner*—Daniel J. Wu
*Assistant Examiner*—Son Tang
(74) *Attorney, Agent, or Firm*—Browdy and Neimark, P.L.L.C.

(57) ABSTRACT

A control lever for earth moving machines a plurality of control pushbuttons able to be connected to a plurality of devices of an earth moving machine and to be selectively activated between a condition of operation and a condition of non operation of the related device, and a plurality of visual indicators operatively connected each to one of the pushbuttons to visually indicate the condition of the related pushbutton. Said visual indicators are each constituted by a light source which is lighted when the related pushbutton is in the operating condition, and is turned off when the related pushbutton is in the non operating condition. The visual indicators are positioned in correspondence with a summit area of the lever, and have a mutual disposition similar to that of the respective pushbuttons to be easily associated visually to the related pushbutton.

5 Claims, 1 Drawing Sheet

CONTROL LEVER FOR EARTH MOVING MACHINES

BACKGROUND OF THE INVENTION

The present invention relates to a control lever for earth moving machine of the type comprising the characteristics set out in the preamble to claim 1.

Many currently used earth moving machines employ, for their actuation, two control levers positioned one to the right and one to the left of the operator.

The control levers are generally constituted by a base that can be fastened to the earth moving machine, whereto is associated a grip having substantially vertical development.

The control lever can be inclined in all directions, and to its motion is associated the actuation of the machine.

Over the years, to the control levers have also been applied additional controls, constituted by pushbuttons, to direct the operation of a plurality of devices with which earth moving machines have been provided.

Said pushbuttons can be activated selectively between two extreme conditions, for the operation or non operation of the device controlled thereby.

Among the pushbuttons one can distinguish those with stable activation, in which a single pressure of the pushbutton determines its condition until the next pressure, and those with transitory activation, in which the operating (and non operating) condition of the device is only maintained while the pushbutton is kept pressed.

Earth moving machines currently available on the market are provided with two control levers, to each of which is associated a plurality of pushbuttons.

Said control levers, however, have a series of drawbacks.

With said control levers, the operation of the machine as a whole becomes very challenging because of the high number of controls the operator must keep under control at the same time.

In particular, it becomes complicated for the operator always to be perfectly aware of which devices are active at any given time, especially if such devices are controlled by pushbuttons with stable activation.

Moreover, an inexperienced operator who, for instance, has used a certain machines only a few times, may have difficulties finding which pushbuttons controls a given device when, for instance, he/she wants to stop its operation.

SUMMARY OF THE INVENTION

In this situation the technical task constituting the basis for the present invention is to obtain a control lever for earth moving machines that overcomes the aforementioned drawbacks.

In particular, a technical task of the present invention is to obtain a control lever for earth moving machines that allows for simple and rapid identification of the condition of each pushbutton.

Another technical task of the present invention is to obtain a control lever for earth moving machines that facilitates the actuation of the machine even by inexperienced operators The specified technical task and the indicated aims are substantially achieved by a control lever for earth moving machines, as described in the accompanying claims.

BRIEF DESCRIPTION OF THE DRAWINGS

Further features and advantages of the present invention shall become more readily apparent from the detailed description of a preferred, but not exclusive embodiment of a control lever for earth moving machines, illustrated in the accompanying drawings, in which.

DESCRIPTION OF THE PREFERRED EMBODIMENT

Figure 2:
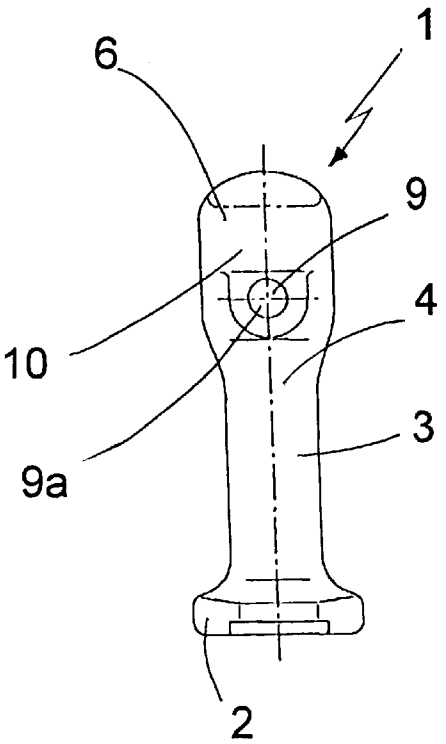
FIG. 2 shows a front side of the control lever for earth moving machines of FIG. 1.
Figure 3:
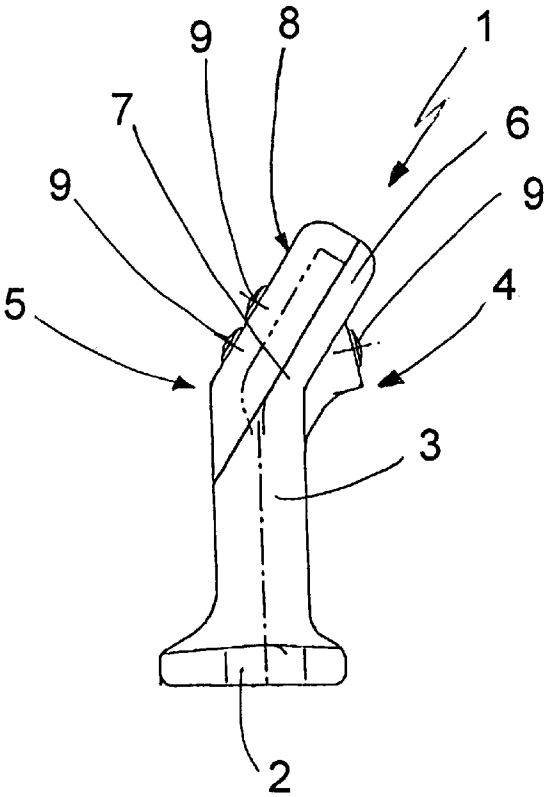
FIG. 3 shows a lateral view of the control lever for earth moving machines of FIG. 1.

With reference to the aforementioned figures, the reference number 1 globally indicates a control lever for earth moving machines according to the present invention.

The control lever 1 is constituted by a base 2 able to be fastened to the earth moving machine, whereto is associated a grip 3 having substantially vertical development.

Once connected to the earth moving machine, the control lever 1 can be inclined in all directions, so that, in known fashion, to its movement can be associated the motion of the machine.

On the control lever 1, a front side 4 and a rear side 5 can be identified.

When the control lever 1 is mounted on an earth moving machine, the front side 4 is destined to be oriented towards the front part of the machine, whilst the rear part 5 is destined to be oriented towards the rear part thereof.

In the illustrated embodiment, the control lever 1 also has the head 6 fastened to the upper end 7 of the grip 3.

Said head 6 is inclined towards the front side 4 of the control lever 1 and has an upper surface 8 which, when the control lever 1 is mounted on an earth moving machine, is substantially oriented towards the position in which the operator is located.

The control lever 1 further comprises a control pushbutton 9 able to be connected to a device of an earth moving machine to command its operation.

The present invention is advantageously applicable also to control levers 1 that comprise a plurality of control pushbuttons 9 able to be associated to a corresponding plurality of devices of an earth moving machine to command their operation.

In the illustrated embodiment, for instance, the control lever 1 is provided with four control pushbuttons 9 positioned three on the upper surface 8 of the head 6 and one on the front side 4 of the lever in correspondence with a lower surface 10 of the head 6.

Each of said pushbuttons 9 can be selectively activated between a first condition in which the device commanded thereby is operating and a second condition in which the device is not operating.

The pushbuttons 9 can indifferently be of the type with stable or transitory activation.

The control lever 1 further comprises a plurality of visual indicators 11 operatively connected each to a pushbutton 9 in order visual to indicate to the operator whether the pushbutton 9 is in the operating condition of the related device or not.

Advantageously the visual indicators 11 are constituted by a light source constituted for instance by a light bulb or by a LED.

As shown in the accompanying drawings, the visual indicators 11 are positioned on the head 6 of the lever higher than the pushbuttons 9 in order always to be easily visible.

The visual indicators 11 are mutually positioned in a manner that is very similar to the mutual disposition of the respective pushbuttons 9.

Figure 1:
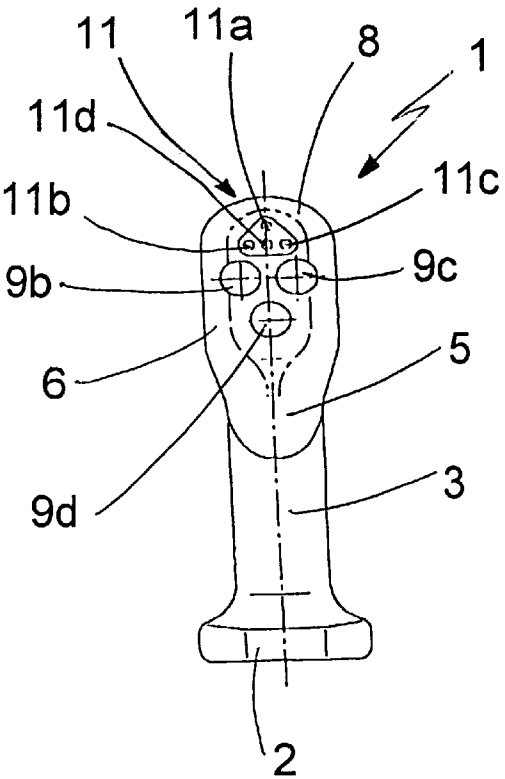
FIG. 1 shows a rear side of a control lever for earth moving machines according to the present invention.

FIG. 1, for instance, shows that the indicators 11 are positioned substantially along a triangle, three on the vertices and one substantially at the center of the base 2 of the triangle.

The indicator 11*a* located on the upper vertex of the triangle is associated to the pushbutton 9*a* located on the front side 4 of the lever, whilst the visual indicators 11*b,* 11*c* located on the other two vertices of the triangle are associated to the two outermost pushbuttons 9*b,* 9*c* among those located on the upper face of the head 6.

Lastly, the indicator 11*d* located in central position is connected to the pushbutton 9*d* situated most centrally among those positioned on the upper face of the head 6.

Advantageously each light source that constitutes a visual indicator 11 that can be set in such a way as to be lighted when the related pushbutton 9 is in the condition of operation of the device, and be off when said pushbutton 9 is in the condition of non operation of the device associated thereto.

This operation in any case is not constraining, as the LED or light bulb may be lighted when the device is deactivated.

When, during the operations of the machine, a pushbutton is operated causing the activation of the device controlled thereby, the related visual indicator 11 indicates its activation to the operator.

If the visual indicator 11 is constituted by a LED or by another light source, it will be turned on (or off) when the pushbutton 9 associated thereto commands the activation of the related device, and be turned off (or on) when the pushbutton 9 associated thereto commands the deactivation of the related device.

The present invention achieve important advantages.

The control lever for earth moving machines of the present invention allows a simple and easy identification of the condition of each pushbutton by the operator who can thus easily keep all the devices of the machine under control.

Moreover with the control lever for earth moving machines of the present invention, actuation of the machine is made easy even for inexperienced operators who can easily identify which pushbuttons, and consequently which devices, are activated at any given time.

should also be noted that the present invention is relatively easy to construct and that also the cost connected to embodying the invention is not very high.

The invention thus conceived can be subject to numerous modifications and variations, without thereby departing from the scope of the inventive concept that characterizes it.

All components can be replaced by technically equivalent elements and in practice all materials employed, as well as the shapes and the dimensions of the various components, can be any according to needs.

What is claimed:

1. A control lever for an earth moving machine, the earth moving machine having a front end and a rear end and being provided with a plurality of individual devices, said control lever having a front side and a rear side and being mountable on the earth moving machine so that said front side is oriented towards the front of the earth moving machine and said rear side is oriented towards the rear of the earth moving machine, said control lever comprising:

a base that is to be fastened to the earth moving machine;

a grip that extends substantially vertically from said base when said base is fastened to the earth moving machine, said grip having an upper end that is remote from said base;

a head fastened to the upper end of said grip and inclined towards the front side of said control lever, said head having an upper surface at said rear side of said lever;

first, second, third and fourth control pushbuttons each connectable to control a respective one of the plurality of individual devices, each of said control pushbuttons being activatable selectively between a condition in which the respective individual device is operating and a condition in the respective individual device is not operating, wherein said first, second, and third control pushbuttons are positioned on said upper surface of said head, at least said first and second control pushbuttons are disposed respectively on left and right sides of said upper surface of said head in horizontal alignment with each other, said third control pushbutton is equally spaced from said first and second control pushbuttons, and said fourth control pushbutton is positioned on said front side of the lever;

and first, second, third and fourth visual indicators each operatively connected to a respective one of said control pushbuttons to visually indicate the condition of the respective one of said control pushbuttons, said visual indicators being grouped and positioned in correspondence with a summit area of said upper surface of said head above said first, second and third control pushbuttons, and said visual indicators having a mutual disposition corresponding to that of the respective pushbuttons in order to each be easily associated visually to a respective pushbutton, wherein said first, second and third visual indicators are horizontally aligned with one another, with said third visual indicator being between said first and the second visual indicator, and said fourth visual indicator being disposed above said first, second and third visual indicators, said first and second visual indicators are disposed respectively on the left and right sides of said upper surface of said and are operatively connected respectively to said first and second control pushbuttons, and said third and fourth indicators are operatively connected respectively to said third and fourth control pushbuttons.

2. A control lever as claimed in claim 1 wherein at least one of said visual indicators is constituted by a light source.

3. A control lever as claimed in claim 2 wherein said light source is lighted when said pushbutton is in said operating condition, and it is off when said pushbutton is in said non operating condition.

4. A control lever as claimed in claim 1 wherein said visual indicators are constituted each by a light source.

5. A control lever as claimed in claim 4 wherein said light sources are lighted when the related pushbutton is in said operating condition, and are off when the related pushbutton is in said non operating condition.

* * * * *